US010475375B2

(12) United States Patent
Deng et al.

(10) Patent No.: US 10,475,375 B2
(45) Date of Patent: Nov. 12, 2019

(54) COMPRESSION METHOD AND DECOMPRESSION METHOD FOR COMPENSATION TABLE OF OLED DISPLAY DEVICE

(71) Applicant: Shenzhen China Star Optoelectronics Semiconductor Display Technology Co., Ltd., Shenzhen (CN)

(72) Inventors: Yufan Deng, Shenzhen (CN); Mingjong Jou, Shenzhen (CN)

(73) Assignee: SHENZHEN CHINA STAR OPTOELECTRONICS SEMICONDUCTOR DISPLAY TECHNOLOGY CO., LTD., Shenzhen, Guangdong (CN)

( * ) Notice: Subject to any disclaimer, the term of this patent is extended or adjusted under 35 U.S.C. 154(b) by 67 days.

(21) Appl. No.: 15/570,375

(22) PCT Filed: Jul. 13, 2017

(86) PCT No.: PCT/CN2017/092686

§ 371 (c)(1),
(2) Date: Oct. 30, 2017

(87) PCT Pub. No.: WO2018/223485

PCT Pub. Date: Dec. 13, 2018

(65) Prior Publication Data

US 2018/0357950 A1 Dec. 13, 2018

(30) Foreign Application Priority Data

Jun. 9, 2017 (CN) ..... 2017 1 0434696

(51) Int. Cl.
*G09G 3/3208* (2016.01)

(52) U.S. Cl.
CPC ... *G09G 3/3208* (2013.01); *G09G 2320/0285* (2013.01); *G09G 2350/00* (2013.01)

(58) Field of Classification Search
CPC ..... G09G 3/3208; G09G 2320/0285; G09G 2350/00
See application file for complete search history.

(56) References Cited

U.S. PATENT DOCUMENTS

2006/0208971 A1 9/2006 Deane
2015/0100556 A1* 4/2015 Sekiguchi ..... H03M 7/30 707/693

(Continued)

FOREIGN PATENT DOCUMENTS

CN 103139567 A 6/2013
CN 104992657 A 10/2015

(Continued)

*Primary Examiner* — Samantha (Yuehan) Wang
(74) *Attorney, Agent, or Firm* — Leong C. Lei

(57) ABSTRACT

The invention provides a compression method and decompression method for compensation table of OLED display device, by performing encoding on the data with equal value successively arranged in the compensation table to compress the data amount of the compensation table, and by adjusting the default threshold to control the condition of starting a stroke encoding to prevent increasing redundancy and data expansion caused by encoding; as such, the compensation table is compressed, the system storage space occupied by the compensation table is reduced and the time of transmitting and burning data on production line is shortened.

9 Claims, 3 Drawing Sheets

(56) References Cited

U.S. PATENT DOCUMENTS

| | | | | |
|---|---|---|---|---|
| 2015/0193905 | A1* | 7/2015 | Lee | H04N 19/119<br>345/501 |
| 2015/0243201 | A1* | 8/2015 | Chung | G09G 3/3225<br>345/690 |
| 2016/0110856 | A1* | 4/2016 | Hoof | H04N 5/243<br>382/283 |

FOREIGN PATENT DOCUMENTS

| | | | |
|---|---|---|---|
| CN | 105700847 | A | 6/2016 |
| CN | 106782300 | A | 5/2017 |

* cited by examiner

COMPRESSION METHOD AND DECOMPRESSION METHOD FOR COMPENSATION TABLE OF OLED DISPLAY DEVICE

BACKGROUND OF THE INVENTION

1. Field of the Invention

The present invention relates to the field of display techniques, and in particular to a compression method and decompression method for compensation table for OLED display device.

2. The Related Arts

The organic light emitting diode (OLED) display provides the advantages of active light-emitting, need for backlight source, high contrast, thinness, wide viewing angle, quick response time, applicable to flexible panel, wide operation temperature range, simple structure and simple manufacturing process, and is regarded as the most promising display technology.

The OLED display device usually comprises: a substrate, an anode disposed on the substrate, an organic light-emitting layer disposed on the anode, an electron transport layer disposed on the organic light-emitting layer, and a cathode disposed on the electron transport layer. In operation, the holes from the anode and the electrons from the cathodes are emitted towards the organic light-emitting layer, and the electrons and holes are combined to generate excited electron-hole pairs, and the excited electron-hole pairs are transformed from the excited state to a base state to achieve light-emission.

Currently, in the manufacturing process of the flat display panel, the defect of mura (uneven luminance) often occurs due to the process imperfection, which leads to bright dots or dark dots and results in poor display quality for the panel. To eliminate the mura in OLED display, the known technique is to use a compensation table to store the compensation information of each pixel in the OLED display. In playback, the driver looks up in the compensation table and adjusts the signal by tuning up the signal of overly dark area in the panel and tuning down the signal of overly bright area in the panel to achieve uniform display effect. In the compensation table, each pixel corresponds to a set of compensation information, and each compensation information set comprises one or more compensation data. The physical meaning of the compensation data depends on the algorithm. In general, the data compensation data is an adjustment value of a specific grayscale or regional gamma value, and some algorithms even set the voltage to be adjusted to as compensation data.

In known technology, the size of compensation table equals to the number of pixels multiplied by the size of each compensation data set. For example, to compensate a 4k2k OLED display panel (the number of pixel columns is 3840, and the number of pixel rows is 2160), if the size of each compensation data set is 24 bits and the number of colors is three (red, green, and blue), the compensation table needs a storage of 2160*3840*24 bits*3≈597 Mb. The large amount of storage space of the system is occupied by the compensation table, and the process of transmitting and burning data takes much time, resulting in the degrading of operation speed and manufacturing efficiency of OLED display.

SUMMARY OF THE INVENTION

The object of the present invention is to provide a compression method for compensation table of OLED display device, able to reduce the system storage space occupied by the compensation table, shorten the time of transmitting and burning data on production line.

Another object of the present invention is to provide a decompression method for compensation table of OLED display device, able to accurately decompress the compensation table compressed by the above compression method, and easy to operate.

To achieve the above object, the present invention provides a compression method for compensation table of OLED display device, comprising the steps of:

Step S1: obtaining a compensation table to be compressed, the compression table to be compressed comprising a plurality of data to be compressed arranged sequentially;

Step S2: reading sequentially the data to be compressed in the compensation table to be compressed, when the number of read data to be compressed with equal value exceeding or equal to a default threshold, performing encoding on the data to be compressed, generating corresponding compressed data, and writing the compressed data into a compressed file; otherwise, writing the read data to be compressed directly into the compressed file.

According to a preferred embodiment of the present invention, specifically, Step S2 comprises:

Step S21: letting i=1, N as default threshold;

Step S22: reading sequentially the i-th to (i+N−1)-th data to be compressed, and determining whether the i-th to (i+N−1)-th data to be compressed being equal; if so, setting j=0 and proceeding to Step S23; otherwise, proceeding to Step S27;

Step S23: continuing reading the (i+N+j)-th data to be compressed;

Step S24: determining whether the (i+N+j)-th data to be compressed equal to the i-th data to be compressed; if so, setting j=j+1, and returning to Step S23; otherwise, proceeding to Step S25;

Step S25: performing encoding on the read data to be compressed with equal value to obtain a compressed data, the compressed data comprising: a marker byte, a stroke length, and a stroke code, wherein the marker byte indicating that data being default value of the compressed data, the stroke length being the number of the read data to be compressed with equal value, and the stroke code being the value of the data to be compressed with equal value;

Step S26: writing the compressed data into a compressed file, and determining whether finishing reading all the data to be compressed; if not, setting i=i+N+j, and returning to step S22; otherwise, terminating;

Step S27: writing the i-th to (i+N−1)-th data to be compressed into the compressed file, and determining whether finishing reading all the data to be compressed; if not, setting i=i+N, and returning to step S22; otherwise, terminating.

According to a preferred embodiment of the present invention, the default threshold is greater than or equal to 4.

According to a preferred embodiment of the present invention, the method further comprises a step before Step S1: obtaining a compensation table of OLED display device, and pre-processing the compensation table of OLED display device to generate a compensation table to be compressed.

According to a preferred embodiment of the present invention, the compensation table to be compressed and the compensation table of OLED display device are of a same size; the first data to be compressed in the compensation table to be compressed and the first compensation data in the compensation table of OLED display device are of a same value, and the M-th data to be compressed in the compensation table to be compressed has a value equals to the difference between value of the M-th compensation data and value of the (M−1)-th compensation data in the compensation table of OLED display device, and M is a positive integer greater than 1.

The present invention also provides a decompressing method for compensation table of OLED display device, comprising the steps of:

Step S1': obtaining a compressed file to be decompressed, the compressed file comprising a plurality of data to be decompressed arranged sequentially, the data to be decompressed comprising: a plurality of compressed data and a plurality of non-compressed data; the compressed data comprising: a marker byte, a stroke length, and a stroke code;

Step S2': reading sequentially the data to be decompressed in the compressed file to be decompressed, when a compressed data being read, decompressing the compressed data to obtain a plurality of decompressed data with equal value, and writing the plurality of decompressed data into a compensation table; when a non-compressed data being read, writing the non-compressed data directly into the compensation table;

the value of the decompressed equal to the stroke code and the number of the decompressed data equal to the stroke length;

when a marker byte being read in Step S2', determining the currently read data to be decompressed being a compressed data; other determining the currently read data to be decompressed being a non-compressed data.

According to a preferred embodiment of the present invention, the stroke length is greater than or equal to 4.

According to a preferred embodiment of the present invention, the method further comprises Step S3': restoring the compensation table obtained in Step S2' to a compensation table of OLED display device.

According to a preferred embodiment of the present invention, step S2' obtains a compensation table comprising a plurality of decompressed data arranged sequentially, the first compensation data in the compensation table of OLED display device has the same value as the first decompressed data in the compensation table obtained in step S2'; the M-th compensation data in the compensation table of OLED display device has a value equals to the sum of value of the M-th decompressed data in the compensation table obtained in step S2' and value of the (M−1)-th compensation data in the compensation table of OLED display device, and M is a positive integer greater than 1.

The present invention provides yet another compression method for compensation table of OLED display device, comprising the steps of:

Step S1: obtaining a compensation table to be compressed, the compression table to be compressed comprising a plurality of data to be compressed arranged sequentially;

Step S2: reading sequentially the data to be compressed in the compensation table to be compressed, when the number of read data to be compressed with equal value exceeding or equal to a default threshold, performing encoding on the data to be compressed, generating corresponding compressed data, and writing the compressed data into a compressed file; otherwise, writing the read data to be compressed directly into the compressed file.

wherein, specifically, Step S2 comprises:

Step S21: letting i=1, N as default threshold;

Step S22: reading sequentially the i-th to (i+N−1)-th data to be compressed, and determining whether the i-th to (i+N−1)-th data to be compressed being equal; if so, setting j=0 and proceeding to Step S23; otherwise, proceeding to Step S27;

Step S23: continuing reading the (i+N+j)-th data to be compressed;

Step S24: determining whether the (i+N+j)-th data to be compressed equal to the i-th data to be compressed; if so, setting j=j+1, and returning to Step S23; otherwise, proceeding to Step S25;

Step S25: performing encoding on the read data to be compressed with equal value to obtain a compressed data, the compressed data comprising: a marker byte, a stroke length, and a stroke code, wherein the marker byte indicating that data being default value of the compressed data, the stroke length being the number of the read data to be compressed with equal value, and the stroke code being the value of the data to be compressed with equal value;

Step S26: writing the compressed data into a compressed file, and determining whether finishing reading all the data to be compressed; if not, setting i=i+N+j, and returning to step S22; otherwise, terminating;

Step S27: writing the i-th to (i+N−1)-th data to be compressed into the compressed file, and determining whether finishing reading all the data to be compressed; if not, setting i=i+N, and returning to step S22; otherwise, terminating;

wherein the default threshold is greater than or equal to 4;

wherein the method further comprises a step before Step S1: obtaining a compensation table of OLED display device, and pre-processing the compensation table of OLED display device to generate a compensation table to be compressed;

wherein the compensation table to be compressed and the compensation table of OLED display device are of a same size; the first data to be compressed in the compensation table to be compressed and the first compensation data in the compensation table of OLED display device are of a same value, and the M-th data to be compressed in the compensation table to be compressed has a value equals to the difference between value of the M-th compensation data and value of the (M−1)-th compensation data in the compensation table of OLED display device, and M is a positive integer greater than 1.

Compared to the known techniques, the present invention provides the following advantages. The present invention provides a compression method and decompression method for compensation table of OLED display device, by performing encoding on the data with equal value successively arranged in the compensation table to compress the data amount of the compensation table, and by adjusting the default threshold to control the condition of starting a stroke encoding to prevent increasing redundancy and data expansion caused by encoding; as such, the compensation table is compressed, the system storage space occupied by the compensation table is reduced and the time of transmitting and burning data on production line is shortened. The present invention also provides a decompression method for compensation table of OLED display device, able to accurately decompress the compensation table compressed by the above compression method, and easy to operate.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

To further explain the technique means and effect of the present invention, the following uses preferred embodiments and drawings for detailed description.

Figure 1:
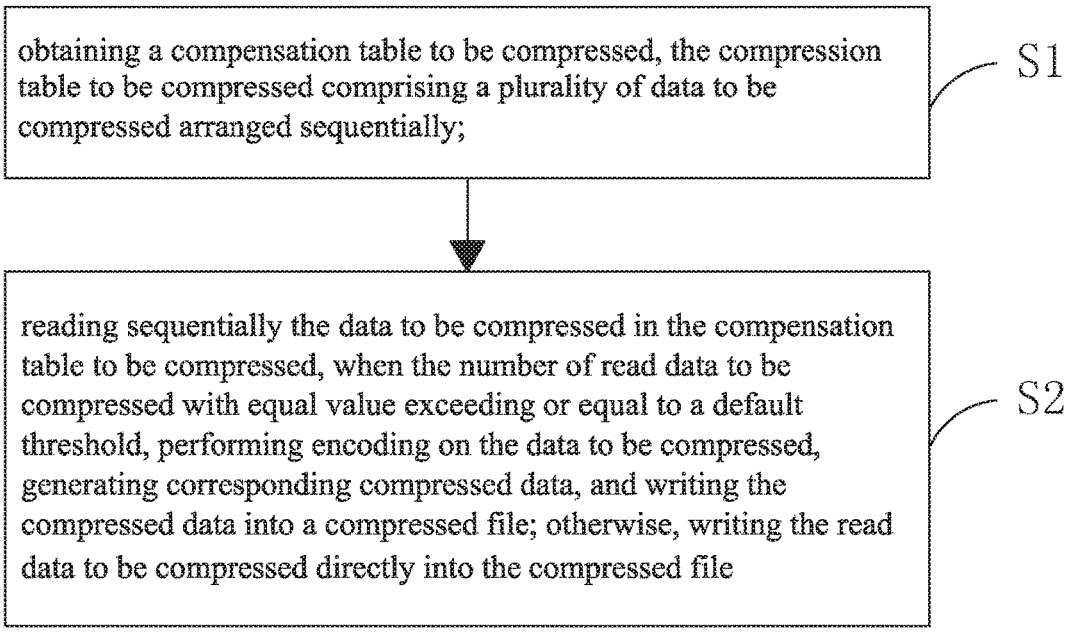
FIG. 1 is a schematic view showing a flowchart of the compression method for compensation table of OLED display device according to the present invention.

Referring to FIG. 1, the present invention provides a compression method for compensation table of OLED display panel, comprising:

Step S1: obtaining a compensation table to be compressed, the compression table to be compressed comprising a plurality of data to be compressed arranged sequentially;

Step S2: reading sequentially the data to be compressed in the compensation table to be compressed, when the number of read data to be compressed with equal value exceeding or equal to a default threshold, performing encoding on the data to be compressed, generating corresponding compressed data, and writing the compressed data into a compressed file; otherwise, writing the read data to be compressed directly into the compressed file.

Figure 2:
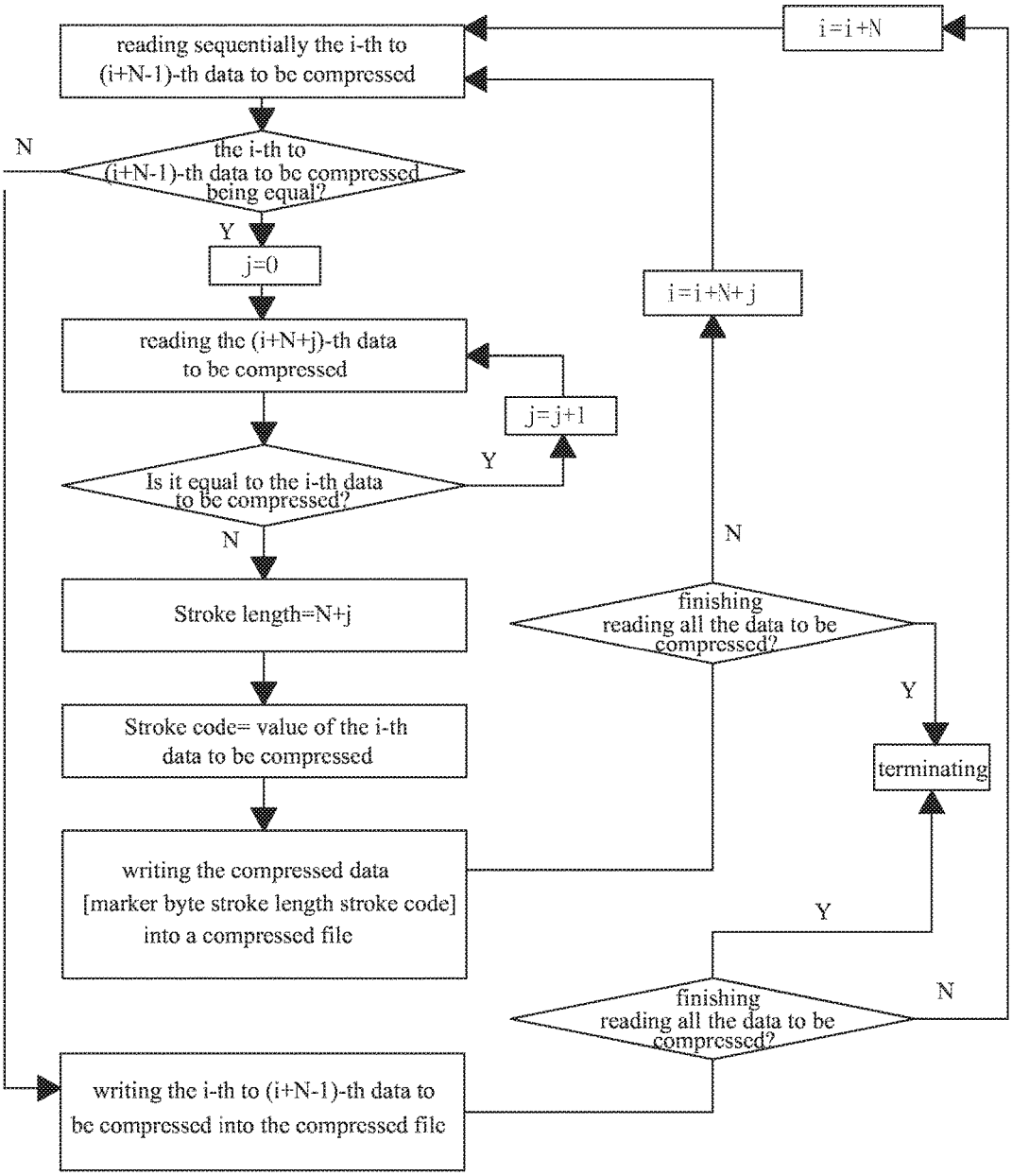
FIG. 2 is a schematic view showing the flowchart of step S2 of the compression method for compensation table of OLED display device according to the present invention.

Specifically, referring to FIG. 2, Step S2 comprises:

Step S21: letting i=1, N as default threshold;

Step S22: reading sequentially the i-th to (i+N−1)-th data to be compressed, and determining whether the i-th to (i+N−1)-th data to be compressed being equal; if so, setting j=0 and proceeding to Step S23; otherwise, proceeding to Step S27;

Step S23: continuing reading the (i+N+j)-th data to be compressed;

Step S24: determining whether the (i+N+j)-th data to be compressed equal to the i-th data to be compressed; if so, setting j=j+1, and returning to Step S23; otherwise, proceeding to Step S25;

Step S25: performing encoding on the read data to be compressed with equal value to obtain a compressed data, the compressed data comprising: a marker byte, a stroke length, and a stroke code, wherein the marker byte indicating that data being default value of the compressed data, the stroke length being the number of the read data to be compressed with equal value, and the stroke code being the value of the data to be compressed with equal value;

Step S26: writing the compressed data into a compressed file, and determining whether finishing reading all the data to be compressed; if not, setting i=i+N+j, and returning to step S22; otherwise, terminating;

Step S27: writing the i-th to (i+N−1)-th data to be compressed into the compressed file, and determining whether finishing reading all the data to be compressed; if not, setting i=i+N, and returning to step S22; otherwise, terminating.

Preferably, to prevent redundancy and data expansion caused by encoding, the default threshold is greater than or equal to 4.

Specifically, the value of the marker byte has a value totally different from all the data to be compressed in the compensation table to be compressed to avoid misjudge the non-compressed data as compressed data during decompression and lead to error.

For example, for the compensation table to be compressed as shown in Table 1 is provided in step S1.

TABLE 1

| compensation table to be compressed | | | | | |
|---|---|---|---|---|---|
| 3 | 3 | 3 | 3 | 3 | 3 |
| 3 | 2 | 2 | 2 | 2 | 2 |
| 2 | 2 | 4 | 4 | 4 | 2 |
| 5 | 5 | 5 | 5 | 5 | 5 |

Assume that the compensation to be compressed in Table 1 corresponds to a compensation table for a grayscale image. The original compensation does not comprise a value 127, therefore the marker byte is set as 127. In the mean time, to avoid ineffective encoding causing data expansion, the default threshold is set to 4. The specific compression is as follows:

First, starting with the first data to be compressed, and reading four data to be compressed. As the four data to be compressed all equal to 3, continuing reading data to be compressed, and realizing the fifth to seventh data to be compressed also equal to 3, and the eighth data to be compressed not equal to 3. Then, the encoding stops after reading the eighth data to be compressed. At this point, the stroke length is 7, and the stroke code is 3. Therefore, the compressed file is written in with a compressed data formed by marker byte, stroke length and stroke code [127 7 3]. Then, starting at the eighth data to be compressed, and reading four data to be compressed. As the four data to be compressed all equal to 2, and then starting stroke encoding and continuing reading data to be compressed, and realizing the twelfth to fourteenth data to be compressed also equal to 2, and the fifteenth data to be compressed not equal to 2. Then, the encoding stops after reading the fifteenth data to be compressed. At this point, the stroke length is 7, and the stroke code is 2. Therefore, the compressed file is written in with a compressed data [127 7 2]. Then, starting at the fifteenth data to be compressed, and reading four data to be compressed. As the four data to be compressed are different, and then the fifteenth to eighteenth data to be compressed are directly written into the compressed file, i.e., [4 4 4 2]. Finally, starting at the nineteenth data to be compressed, and reading four data to be compressed. As the four data to be compressed all equal to 5, and then starting stroke encoding and writing the compressed data [127 6 5] into the compressed file to obtain the compressed file: 127 7 3 127 7 2 4 4 4 2 127 6 5. The size of data to be compressed is reduced from 24 bytes to 13 bytes.

Moreover, the compensation table to be compressed can be an original compensation table of OLED display device, or a preprocessed compensation table of OLED display device. In other words, the compression method may further comprise a step before Step S1: obtaining a compensation table of OLED display device, and pre-processing the compensation table of OLED display device to generate a compensation table to be compressed.

Specifically, when the compensation table to be compressed is a preprocessed compensation table of OLED display device, the compensation table to be compressed and the compensation table of OLED display device are of a same size; the first data to be compressed in the compensation table to be compressed and the first compensation data in the compensation table of OLED display device are of a same value, and the M-th data to be compressed in the compensation table to be compressed has a value equals to the difference between value of the M-th compensation data and value of the (M−1)-th compensation data in the compensation table of OLED display device, and M is a positive integer greater than 1.

It should be noted that when the compensation table of OLED display device comprises a large amount of gradually changing data, the compression efficiency to the gradually changing area can be enhanced by pre-processing the compensation table of OLED display device and then performing encoding. For example, the original compensation table of OLED display device comprises gradually changing data 2, 3, 4, 5, 6. After pre-processing, the data becomes 2, 1, 1, 1, 1. As such, the data originally unable to be compressed can now be compressed, and the compression efficiency is improved for the gradually changing area.

Figure 3:
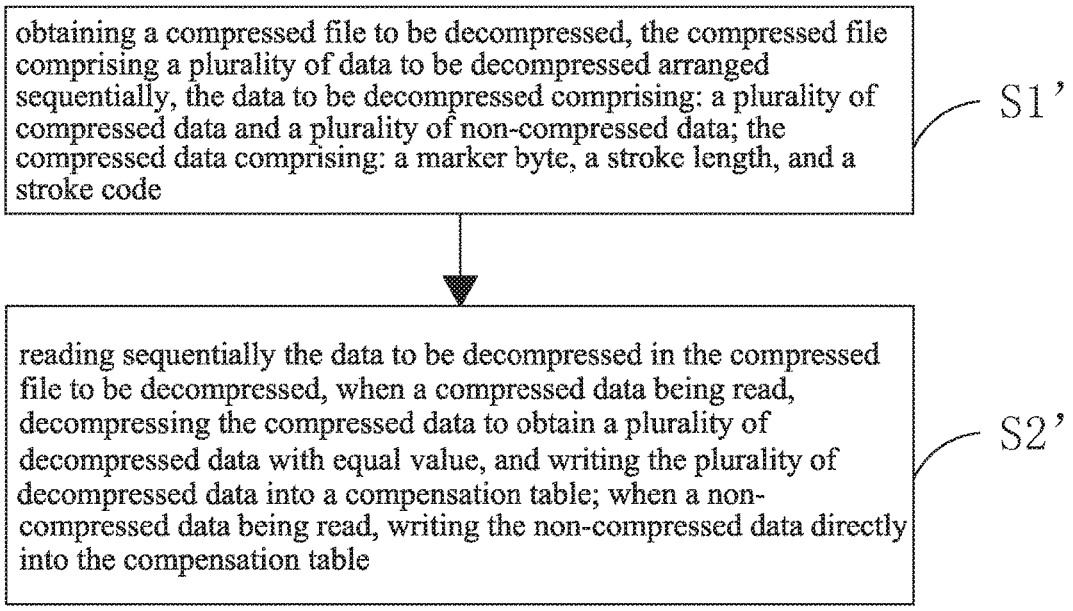
FIG. 3 is a schematic view showing a flowchart of the decompression method for compensation table of OLED display device according to the present invention.

Refer to FIG. 3. The present invention also provides a decompressing method for compensation table of OLED display device, comprising the steps of:

Step S1': obtaining a compressed file to be decompressed, the compressed file comprising a plurality of data to be decompressed arranged sequentially, the data to be decompressed comprising: a plurality of compressed data and a plurality of non-compressed data; the compressed data comprising: a marker byte, a stroke length, and a stroke code;

Step S2': reading sequentially the data to be decompressed in the compressed file to be decompressed, when a compressed data being read, decompressing the compressed data to obtain a plurality of decompressed data with equal value, and writing the plurality of decompressed data into a compensation table; when a non-compressed data being read, writing the non-compressed data directly into the compensation table;

the value of the decompressed equal to the stroke code and the number of the decompressed data equal to the stroke length;

when a marker byte being read in Step S2', determining the currently read data to be decompressed being a compressed data; other determining the currently read data to be decompressed being a non-compressed data.

Specifically, the value of the marker byte has a value totally different from all the data to be compressed in the compensation table to be compressed to avoid misjudge the non-compressed data as compressed data during decompression and lead to error.

Preferably, to prevent redundancy and data expansion caused by encoding, the default threshold is greater than or equal to 4.

For example, the compressed file obtained in step S1' comprises: 127 7 3 127 7 2 4 4 4 2 127 6 5. At this point, the first data to be decompressed in the compressed file is read, and the first data to be decompressed is 127, a marker byte. The method determines that the data to be decompressed is a compressed data, and reads the second and third data to be decompressed to obtain the stroke length and the stroke code of the compressed data are 7 and 3 respectively. After decompression, the decompressed data 3 3 3 3 3 3 3 is obtained, and written into the compensation table. Then, the fourth data to be decompressed in the compressed file is read, and the fourth data to be decompressed is 127, a marker byte. The method determines that the data to be decompressed is a compressed data, and reads the fifth and sixth data to be decompressed to obtain the stroke length and the stroke code of the compressed data are 7 and 2 respectively. After decompression, the decompressed data 2 2 2 2 2 2 2 is obtained, and written into the compensation table. Then, the seventh to the tenth data to be decompressed are read, and none is the marker byte 127. The method determines to be non-compressed data and the writes the seventh to the tenth data to be decompressed 4 4 4 2 directly into the compensation file. Finally, the eleventh data to be decompressed in the compressed file is read, and the eleventh data to be decompressed is 127, a marker byte. The method determines that the data to be decompressed is a compressed data, and reads the twelfth and thirteenth data to be decompressed to obtain the stroke length and the stroke code of the compressed data are 6 and 5 respectively. After decompression, the decompressed data 5 5 5 5 5 5 is obtained, and written into the compensation table. At the end of decompression, the compensation table comprising a plurality of compensation value arranged sequentially as shown in Table 1 is obtained.

Moreover, the decompression method further comprises Step S3': restoring the compensation table obtained in Step S2' to a compensation table of OLED display device.

According to a preferred embodiment of the present invention, step S2' obtains a compensation table comprising a plurality of decompressed data arranged sequentially, the first compensation data in the compensation table of OLED display device has the same value as the first decompressed data in the compensation table obtained in step S2'; the M-th compensation data in the compensation table of OLED display device has a value equals to the sum of value of the M-th decompressed data in the compensation table obtained in step S2' and value of the (M−1)-th compensation data in the compensation table of OLED display device, and M is a positive integer greater than 1. For example, the decompression method obtains the decompressed data in the compensation table as 2, 1, 1, 1, 1, and be restored as the compensation data in the compensation table of OLED display device as 2, 3, 4, 5, 6.

In summary, the present invention provides a compression method and decompression method for compensation table of OLED display device, by performing encoding on the data with equal value successively arranged in the compensation table to compress the data amount of the compensation table, and by adjusting the default threshold to control the condition of starting a stroke encoding to prevent increasing redundancy and data expansion caused by encoding; as such, the compensation table is compressed, the system storage space occupied by the compensation table is reduced and the time of transmitting and burning data on production line is shortened. The present invention also provides a decompression method for compensation table of OLED display device, able to accurately decompress the compensation table compressed by the above compression method, and easy to operate.

It should be noted that in the present disclosure the terms, such as, first, second are only for distinguishing an entity or operation from another entity or operation, and does not imply any specific relation or order between the entities or operations. Also, the terms "comprises", "include", and other similar variations, do not exclude the inclusion of other non-listed elements. Without further restrictions, the expression "comprises a . . . " does not exclude other identical elements from presence besides the listed elements.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

What is claimed is:

1. A method for compressing a compensation table of an organic light-emitting diode (OLED) display device, comprising the steps of:

Step S1: obtaining a compensation table of an OLED display device, which is loaded with compensation data for pixels of the OLED display device, to provide a compensation table to be compressed, the compression table to be compressed comprising the compensation data for the pixels of the OLED display device as a plurality of data to be compressed that are arranged sequentially; and Step S2: reading sequentially the data to be compressed in the compensation table to be compressed, when the number of read data to be compressed with equal value exceeding or equal to a default threshold, performing encoding on the data to be compressed, generating corresponding compressed data, and writing the compressed data into a compressed file; otherwise, writing the read data to be compressed directly into the compressed file;

wherein Step 2 comprises:

Step S21: letting i=1, N as default threshold;

Step S22: reading sequentially the i-th to (i+N−1)-th data to be compressed, and determining whether the i-th to (i+N−1)-th data to be compressed being equal; if so, setting j=0 and proceeding to Step S23; otherwise, proceeding to Step S27;

Step S23: continuing reading the (i+N+j)-th data to be compressed;

Step S24: determining whether the (i+N+j)-th data to be compressed equal to the i-th data to be compressed; if so, setting j=j+1, and returning to Step S23; otherwise, proceeding to Step S25;

Step S25: performing encoding on the read data to be compressed with equal value to obtain a compressed data, the compressed data comprising: a marker byte, a stroke length, and a stroke code, wherein the marker byte indicating that data being default value of the compressed data, the stroke length being the number of the read data to be compressed with equal value, and the stroke code being the value of the data to be compressed with equal value;

Step S26: writing the compressed data into a compressed file, and determining whether finishing reading all the data to be compressed; if not, setting i=i+N+j, and returning to step S22; otherwise, terminating; and Step S27: writing the i-th to (i+N−1)-th data to be compressed into the compressed file, and determining whether finishing reading all the data to be compressed; if not, setting i=i+N, and returning to step S22; otherwise, terminating.

2. The method as claimed in claim 1, wherein the default threshold is greater than or equal to 4.

3. The method as claimed in claim 1, wherein the method further comprises a step of pre-processing the compensation table of the OLED display device to generate the compensation table to be compressed.

4. The method as claimed in claim 3, wherein the compensation table to be compressed and the compensation table of the OLED display device are of a same size; the first data to be compressed in the compensation table to be compressed and the first compensation data in the compensation table of OLED display device are of a same value, and the M-th data to be compressed in the compensation table to be compressed has a value equal to the difference between value of the M-th compensation data and value of the (M−1)-th compensation data in the compensation table of the OLED display device, where M is a positive integer greater than 1.

5. A method for processing a compensation table of an organic light-emitting diode (OLED) display device, comprising a compression process that comprises the following steps:

Step S1: obtaining a compensation table of an OLED display device, which is loaded with compensation data for pixels of the OLED display device, to provide a compensation table to be compressed, the compression table to be compressed comprising the compensation data for the pixels of the OLED display device as a plurality of data to be compressed that are arranged sequentially; and Step S2: reading sequentially the data to be compressed in the compensation table to be compressed, when the number of read data to be compressed with equal value exceeding or equal to a default threshold, performing encoding on the data to be compressed, generating corresponding compressed data, and writing the compressed data into a compressed file; otherwise, writing the read data to be compressed directly into the compressed file;

wherein Step 2 comprises:

Step S21: letting i=1, N as default threshold;

Step S22: reading sequentially the i-th to (i+N−1)-th data to be compressed, and determining whether the i-th to (i+N−1)-th data to be compressed being equal; if so, setting j=0 and proceeding to Step S23; otherwise, proceeding to Step S27;

Step S23: continuing reading the (i+N+j)-th data to be compressed;

Step S24: determining whether the (i+N+j)-th data to be compressed equal to the i-th data to be compressed; if so, setting j=j+1, and returning to Step S23; otherwise, proceeding to Step S25;

Step S25: performing encoding on the read data to be compressed with equal value to obtain a compressed data, the compressed data comprising: a marker byte, a stroke length, and a stroke code, wherein the marker byte indicating that data being default value of the compressed data, the stroke length being the number of the read data to be compressed with equal value, and the stroke code being the value of the data to be compressed with equal value;

Step S26: writing the compressed data into a compressed file, and determining whether finishing reading all the data to be compressed; if not, setting i=i+N+j, and returning to step S22; otherwise, terminating; and Step S27: writing the i-th to (i+N−1)-th data to be compressed into the compressed file, and determining whether finishing reading all the data to be compressed; if not, setting i=i+N, and returning to step S22; otherwise, terminating; and a decompression process comprises the following steps:

Step S1': obtaining the compressed file as a compressed filed to be decompressed, wherein the compressed file comprises a plurality of data to be decompressed arranged sequentially, the data to be decompressed comprising: a plurality of compressed data and a plurality of non-compressed data; the compressed data comprising: a marker byte, a stroke length, and a stroke code;

Step S2': reading sequentially the data to be decompressed in the compressed file to be decompressed, when a compressed data being read, decompressing the compressed data to obtain a plurality of decompressed data with equal value, and writing the plurality of decompressed data into a compensation table; when a non-compressed data being read, writing the non-compressed data directly into the compensation table;

the value of the decompressed equal to the stroke code and the number of the decompressed data equal to the stroke length;

when a marker byte being read in Step S2', determining the currently read data to be decompressed being a compressed data; other determining the currently read data to be decompressed being a non-compressed data.

6. The method as claimed in claim 5, wherein the stroke length is greater than or equal to 4.

7. The method as claimed in claim 5, wherein the method further comprises Step S3': restoring the compensation table obtained in Step S2' to the compensation table of the OLED display device.

8. The method as claimed in claim 7, wherein step S2' obtains a compensation table comprising a plurality of decompressed data arranged sequentially, the first compensation data in the compensation table of OLED display device has the same value as the first decompressed data in the compensation table obtained in step S2'; the M-th compensation data in the compensation table of OLED display device has a value equals to the sum of value of the M-th decompressed data in the compensation table obtained in step S2' and value of the (M−1)-th compensation data in the compensation table of OLED display device, and M is a positive integer greater than 1.

9. A method for compressing a compensation table of an organic light-emitting diode (OLED) display device, comprising the steps of:

Step S1: obtaining a compensation table of an OLED display device, which is loaded with compensation data for pixels of the OLED display device, to provide a compensation table to be compressed, the compression table to be compressed comprising the compensation data for the pixels of the OLED display device as a plurality of data to be compressed that are arranged sequentially; and Step S2: reading sequentially the data to be compressed in the compensation table to be compressed, when the number of read data to be compressed with equal value exceeding or equal to a default threshold, performing encoding on the data to be compressed, generating corresponding compressed data, and writing the compressed data into a compressed file; otherwise, writing the read data to be compressed directly into the compressed file;

wherein Step S2 comprises:

Step S21: letting i=1, N as default threshold;

Step S22: reading sequentially the i-th to (i+N−1)-th data to be compressed, and determining whether the i-th to (i+N−1)-th data to be compressed being equal; if so, setting j=0 and proceeding to Step S23; otherwise, proceeding to Step S27;

Step S23: continuing reading the (i+N+j)-th data to be compressed;

Step S24: determining whether the (i+N+j)-th data to be compressed equal to the i-th data to be compressed; if so, setting j=j+1, and returning to Step S23; otherwise, proceeding to Step S25;

Step S25: performing encoding on the read data to be compressed with equal value to obtain a compressed data, the compressed data comprising: a marker byte, a stroke length, and a stroke code, wherein the marker byte indicating that data being default value of the compressed data, the stroke length being the number of the read data to be compressed with equal value, and the stroke code being the value of the data to be compressed with equal value;

Step S26: writing the compressed data into a compressed file, and determining whether finishing reading all the data to be compressed; if not, setting i=i+N+j, and returning to step S22; otherwise, terminating; and Step S27: writing the i-th to (i+N−1)-th data to be compressed into the compressed file, and determining whether finishing reading all the data to be compressed; if not, setting i=i+N, and returning to step S22; otherwise, terminating;

wherein the default threshold is greater than or equal to 4;

wherein the method further comprises a step before Step S1: obtaining a compensation table of OLED display device, and pre-processing the compensation table of OLED display device to generate a compensation table to be compressed;

wherein the compensation table to be compressed and the compensation table of OLED display device are of a same size; the first data to be compressed in the compensation table to be compressed and the first compensation data in the compensation table of OLED display device are of a same value, and the M-th data to be compressed in the compensation table to be compressed has a value equals to the difference between value of the M-th compensation data and value of the (M−1)-th compensation data in the compensation table of OLED display device, and M is a positive integer greater than 1.

* * * * *